United States Patent [19]

Wallace

[11] 3,971,099

[45] July 27, 1976

[54] HINGE ASSEMBLY STOP ATTACHMENT

[76] Inventor: David L. Wallace, 2924 Cresent Drive, Stillwater, Okla. 74074

[22] Filed: June 23, 1975

[21] Appl. No.: 589,055

[52] U.S. Cl. ..... 16/50; 16/137; 16/191

[51] Int. Cl.[2] ..... E05F 3/20

[58] Field of Search ..... 16/50, 72, 190, 191, 16/188, 189, 137, 82, 71, 128 R, 135, 168

[56] References Cited

UNITED STATES PATENTS

| | | | |
|---|---|---|---|
| 1,903,251 | 3/1933 | Ahrens | 16/191 |
| 2,586,757 | 2/1952 | Wammel et al. | 16/137 |
| 2,591,984 | 4/1952 | Walsh | 16/137 |
| 2,803,850 | 8/1957 | Hooper | 16/191 X |
| 2,993,226 | 7/1961 | Baker et al. | 16/191 |
| 3,538,539 | 11/1970 | Allison | 16/191 |

*Primary Examiner*—G. V. Larkin
*Attorney, Agent, or Firm*—Dunlap, Codding & McCarthy

[57] ABSTRACT

An improved stop attachment removably connectable to a hinge assembly for adjustably limiting the degree of angular movement of a hinge assembly, the stop attachment including a housing assembly and a stop sleeve. The stop sleeve is movable with respect to the housing assembly for selectively positioning a first and a second stop surface formed on the stop sleeve with respect to a first and a second stop surface, respectively, formed on the housing assembly. In each selectively adjusted position of the stop sleeve and the housing assembly, at least one of the first stop surfaces of the stop sleeve and the housing assembly engages a first hinge leaf of the hinge assembly and at least one of the second stop surfaces of the stop sleeve and the housing assembly engages a second hinge leaf of the hinge assembly thereby selectively and adjustingly limiting the degree of angular movement of the first and the second hinge leaves.

17 Claims, 12 Drawing Figures

HINGE ASSEMBLY STOP ATTACHMENT

BACKGROUND OF THE INVENTION

1. Field of the Invention

The present invention relates generally to improvements in stop attachments for hinge assemblies and, more particularly, but not by way of limitation, to an improved stop attachement for adjustably limiting the degree of angular movement of a hinge assembly.

2. Description of the Prior Art

In the past, various hinge stops and hinge constructions have been proposed for limiting the movement of hinges. Some of the prior art hinge stops have been constructed to adjustably limit the angular movement of the hinge.

The U.S. Pat. No. 2,586,757, issued to Wummel, disclosed a door hinge check having an inside member telescopingly connected to an outside member. The inside and the outside members each included a formed-over end portion for connecting the members to the hinge assembly via the hinge pintle. The outside member was provided with formed-over edges serving as tracks for the inside member and also serving to limit the turning or angular movement of the hinge plates.

The U.S. Pat. No. 3,602,942, issued to Neff, disclosed a door hinge stop comprising a clip shaped to be fitted over the end knuckles of a hinge with an outwardly projecting rib that constituted the limit stop.

The U.S. Pat. No. 3,178,762, issued to Whiting, and No. 2,990,572, issued to Schwartzberg, each disclosed an arcuately shaped element forming a hinge stop which was adjustably connected to one knuckle of the hinge assembly.

The U.S. Pat. No. 2,993,226, issued to Baker, disclosed a pair of stops disposed on opposite ends of a pintle having polygonal shaped extensions for receiving the stops in adjustable stop positions. The U.S. Pat. No. 2,930,075, issued to Deutchman, disclosed an adjustable stop member disposed over an angular sided pintle having a non-rotatable relationship with the stop member and one hinge plate.

The U.S. Pat. No. 2,280,655, issued to Madsen, disclosed a segmental plate having an aperture to receive the pintle and bent-over portions serving as limit stops. Various other hinge stop constructions or the like were disclosed in the U.S. Pat. No. 1,455,550, issued to Rodell; No. 3,592,230, issued to Allen; No. 1,903,251, issued to Ahrens; No. 689,201, issued to Koester; No. 2,799,888, issued to White; No. 3,538,539, issued to Allison; No. 2,843,873, issued to Slower; No. 2,839,779, issued to Haag; No. 2,803,850, issued to Hooper; No. 2,611,921, issued to Weidelstam; No. 1,931,271, issued to Simmons; No. 943,997, issued to Riordan; No. 491,645, issued to Hart; No. 387,886, issued to Jones; and NO. 431,459, issued to Griswold.

DESCRIPTION OF THE PREFERRED EMBODIMENTS

Figure 1:
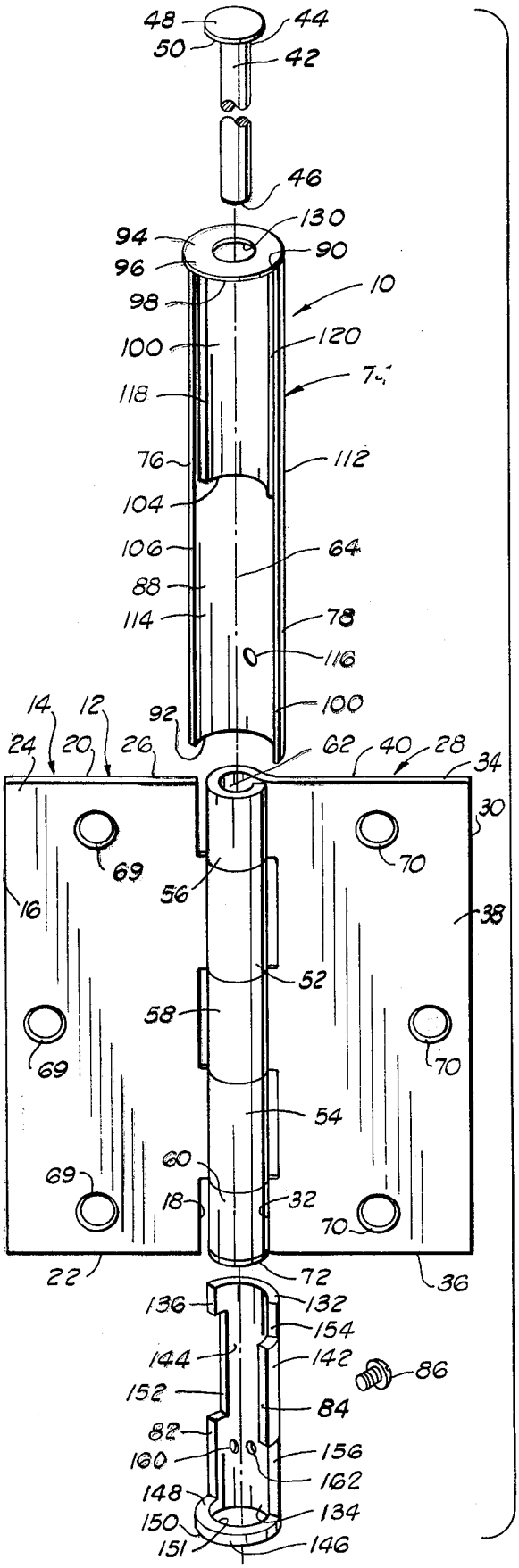
FIG. 1 is a perspective view of the stop attachment of the present invention in a disassembled position showing the housing assembly disposed above a hinge assembly and the stop sleeve disposed below the hinge assembly. A pintle is shown disposed above the housing assembly for removably connecting the housing assembly to the hinge assembly and as fastener is shown positioned near the stop sleeve or connecting the stop sleeve to the housing assembly.

Referring to the drawings in general, and to FIG. 1 in particular, shown therein and designated by the general reference numeral 10 is a stop attachment constructed in accordance with the present invention. The stop attachment 10 is removably connectable to a hinge assembly 12, and the stop attachment 10 is constructed to adjustably limit the degree of angular movement of the hinge assembly 12 in an operating position of the stop attachment 10 connected to the hinge assembly 12. In general, the hinge assembly 12 includes: a generally rectangularly shaped first hinge leaf 14, having a first edge 16, a second edge 18, an upper end 20, a lower end 22, a first face 24 and a second face 26; a generally rectangularly shaped second hinge leaf 28, having a first edge 30, a second edge 32, an upper end 34, a lower end 36, a first face 38 and a second face 40; and a pintle 42 for hingedly connecting the first hinge leaf 14 and the second hinge leaf 28, having opposite ends 44 and 46, and a head 48 secured to the end 44 of the pintle 42, the head 48 providing a surface 50 extending radially outwardly and circumferentially about the pintle 42.

Figure 7:
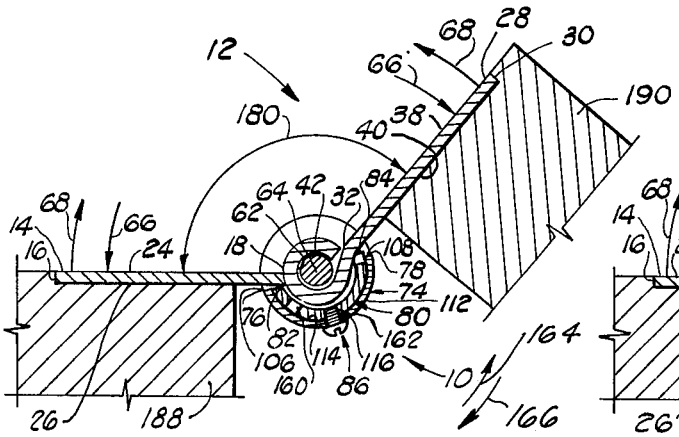
FIG. 7 is a lower end elevational view showing the stop attachment and the hinge assembly in an assembled position with the hinge assembly attached to a stationary member and a movable member, the stop sleeve being positioned with respect to the housing assembly to limit the degree of angular movement of the hinge assembly to one predetermined degree of angular movement.
Figure 8:
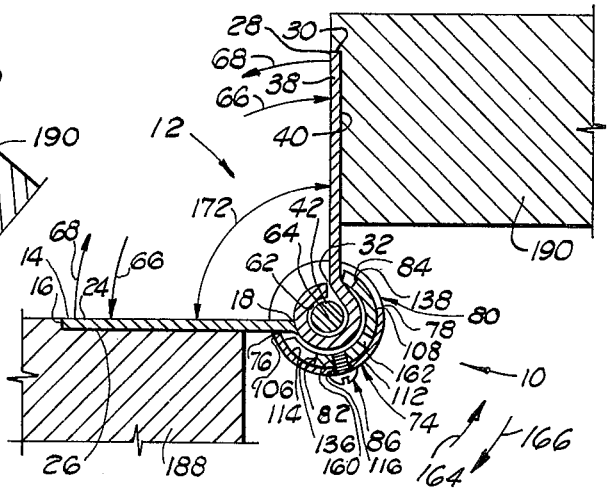
FIG. 8 is a view similar to FIG. 7, but showing the stop sleeve positioned with respect to the housing assembly to limit the degree of angular movement of the hinge assembly to one other predetermined position.

The first hinge leaf 14 has a pair of bushings 52 and 54, each of the bushings 52 and 54 being formed on the second edge 18 and extending a distance therefrom, and the second hinge leaf 28 has three bushings 56, 58 and 60, each of the bushings 56, 58 and 60 being formed on the second edge 32 and extending a distance therefrom. The bushings 52 and 54 are spaced a distance apart, and the bushing 56 is spaced a distance from the bushing 60. Each of the bushings 52, 54, 56, 58 and 60 has an opening extending therethrough, only the opening through the bushing 56 being specifically shown in FIG. 1 and designated therein via the general reference numeral 62, for example. In an assembled position of the hinge assembly 12, the second edge 18 of the first hinge leaf 14 is disposed near the second edge of the second hinge leaf 28, the bushing 52 is disposed generally between the bushings 56 and 58, and the bushing 54 is disposed generally between the bushings 58 and 60. More particularly, the bushings 52, 54, 56, 58 and 60 are positioned such that the openings through each of the bushings 52, 54, 56, 58 and 60 are aligned for receiving the accommodating the pintle 42, the pintle 42 being disposed through the openings in the bushings 52, 54, 56, 58 and 60 and hingedly connecting the first hinge leaf 14 to the second hinge leaf 28 for angular movement of the first hinge leaf 14 relative to the second hinge leaf 28 about a pivot axis 64 generally defined via the pintle 34. As shown in FIGS. 7 and 8, the first and the second hinge leaves 14 and 28 are hingedly connected via the pintle 42 for angular movement about the pivot axis 64 in opening directions 66 wherein the first face 24 of the first hinge leaf 14 is moved generally away from the first face 38 of the second hinge leaf 28 and for angular movement about the pivot axis 64 in closing directions 68 wherein the first face 24 of the first hinge lead 14 is moved generally toward the first face 38 of the second hinge leaf 28.

A plurality of openings 69 are formed through the first hinge leaf 14, each opening 69 intersecting the first and the second faces 24 and 26, and a plurality of openings 70 are formed through the second hinge leaf 28, each opening 70 intersecting the first and the second faces 38 and 40. The openings 69 and 70 are provided to facilitate the connection of the hinge assembly 12 to various structural members for hingedly connecting the structural members in a manner and for reasons well-known in the art. In one embodiment of the hinge assembly 12 as shown in FIGS. 1, 7 and 8, a cap 72 is secured to the bushing 60, and the cap 72 substantially closes the opening (not shown in the drawings) through the bushing 60, thereby closing one end of the aligned openings through the bushings 52, 54, 56, 58 and 60.

It should be noted that hinge assemblies of the type described above with respect to the hinge assembly 12 are commercially available and the stop attachment 10 of the present invention is particularly constructed such that the stop attachment 10 can be easily and quickly secured to an existing hinge assembly for limiting the degree of angular movement of the hinge assembly, thereby limiting the degree of angular movement of the structural members hingedly connected via the hinge assembly. The stop attachment 10 can be utilized in combination with hinge assemblies of various constructions and the particular hinge assembly 12, shown in FIGS. 1, 7 and 8, is merely illustrative of one general type of hinge construction and is utilized merely for the purpose of illustrating the various construction and operation details of the present invention, it being specifically understood that the stop attachment 10 of the present invention is not limited to utilization in cooperation with the hinge assembly 12.

Figure 2:
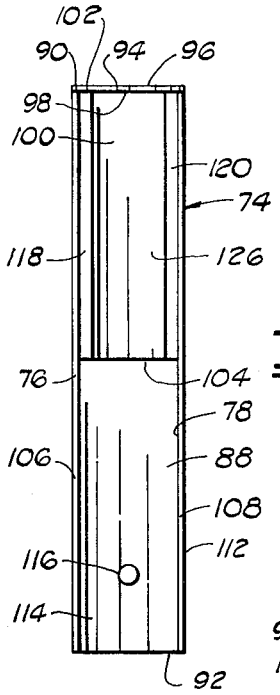
FIG. 2 is an elevational view showing the inner peripheral surface of the housing assembly of FIG. 1.
Figure 3:
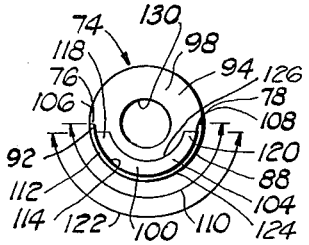
FIG. 3 is a lower end elevational view of the housing assembly of FIG. 2.

As shown more clearly in FIGS. 2 and 3, the stop attachment 10 generally includes: a housing assembly 74, having a first stop surface 76 and a second stop surface 78 formed on portions thereof; a stop sleeve 80, having a first stop surface 82 and a second stop surface 84 formed on portions thereof; and a fastener 86 for connecting the housing assembly 74 to the stop sleeve 80. The housing assembly 74 has a portion removably connectable to the hinge assembly 12 and the stop sleeve 80 has a portion removably connectable to the hinge assembly 12. In the operating position of the stop attachment 10 wherein the stop attachment 10 is connected to the hinge assembly 12, the housing assembly 74 and the stop sleeve 80 each cover a portion of the bushings 52, 54, 56, 58 and 60, and the stop sleeve 80 is positioned with respect to the housing assembly 74 such that at least one of the first stop surfaces 76 and 82 engages the second face 26 of the first hinge leaf 14 and at least one of the second stop surfaces 78 and 84 engages the second face 40 of the second hinge leaf 28 to limit the degree of angular movement of the first and the second hinge leaves 14 and 28 in the opening directions 66 in a manner to be described in greater detail below.

The housing assembly 74 includes: a cover 88, having an upper end 90 and a lower end 92; a circularly shaped attaching plate 94, having an upper side 96 and a lower side 98; and a spacer 100, having an upper end 102 and a lower end 104.

The cover 88 has a first edge 106 extending between the upper and lower ends 90 and 92 and forming the first stop surface 76 of the housing assembly 74, and a second edge 108 extending between the upper and lower ends 90 and 92 and forming the second stop surface 78 of the housing assembly 74. In a preferred embodiment, the cover 88 is formed on a radius and the second edge 108 is spaced an arcuate distance 110 from the first edge 106, thereby forming an outer peripheral surface 112 and an inner peripheral surface 114. An aperture 116 is formed through the cover 88 intersecting the outer and inner peripheral surfaces 112 and 114 thereof, the apertures 116 being disposed generally near the lower end 92 and spaced generally between the first and the second edges 106 and 108, as shown more clearly in FIGS. 2 and 3.

The spacer 100 has a first edge 118, a second edge 120 spaced an arcuate distance 122 from the first edge 118, an outer peripheral surface 124 and an inner peripheral surface 126, the first and the second edges 118 and 120 each extending generally between the upper and lower ends 102 and 104. The spacer 100 is formed on a radius sized such that the outer peripheral surface 124 of the spacer 110 generally conforms to the inner peripheral surface 114 of the cover 88. In an assembled position of the cover 88 and the spacer 100, the spacer 100 is disposed near the inner peripheral surface 114 with the outer peripheral surface 124 of the spacer 100 disposed generally adjacent the inner peripheral surface 114 of the cover 88 and the spacer 100 is securedly connected to the cover 88, the upper end 102 of the spacer 100 being disposed generally near the upper end 90 of the cover 88 in this assembled position wherein the spacer 100 is connected to the cover 88. As shown more clearly in FIG. 2, the lower end 104 of the spacer 100 is spaced a distance from the lower end 92 of the cover 88 thereby forming a space generally between the lower end 104 of the spacer 100 and the lower end 92 of the cover 88, the aperture 116 in the cover 88 being disposed in the space between the lower ends 92 and 104 of the cover 88 and the spacer 100, respectively.

A portion of the lower side 98 of the attaching plate 94, generally adjacent the outer peripheral surface thereof, is connected to the upper end 90 of the cover 88. An aperture 130 is formed through a central portion of the attaching plate 94 to facilitate the removable interconnection of the housing 74 to the hinge assembly 12 via the pintle 42, a portion of the pintle 42 extending through the aperture 130 in an operating position with the stop attachment 10 connected to the hinge assembly 12.

Figure 5:
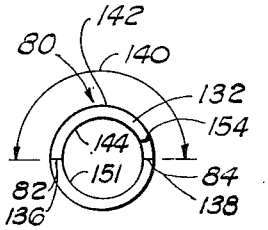
FIG. 5 is an upper end elevational view of the stop sleeve of FIG. 4.
Figure 4:
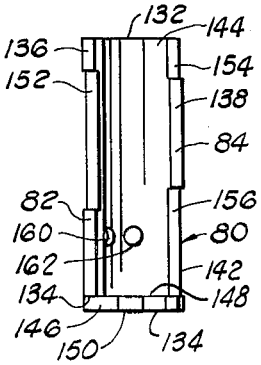
FIG. 4 is an elevational view showing the inner peripheral surface of the stop sleeve of FIG. 1.
Figure 6:
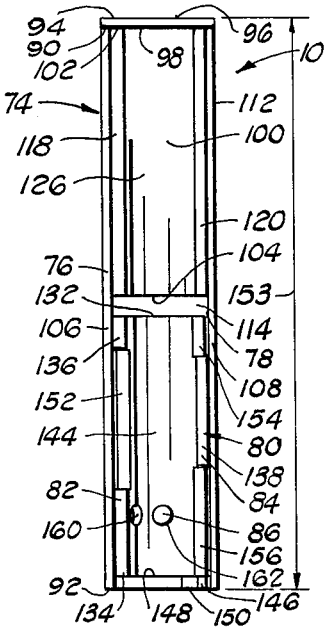
FIG. 6 is an elevational view of the housing assembly and the stop sleeve, similar to FIGS. 2 and 4, but showing the stop sleeve connected to the housing assembly in one assembled position of the stop attachment.

As shown more clearly in FIGS. 4 and 5, the stop sleeve 80 has an upper end 132 and a lower end 134. A first edge 136 is formed on the stop sleeve 80 and extends generally from the upper end 132 to the lower end 134. A second edge 138 is formed on the stop sleeve 80 and extends generally from the upper end 132 to the lower end 134, the second edge 138 being spaced an arcuate distance 140 from the first edge 136. The first edge 136 of the stop sleeve 80 forms the first stop surface 82 and the second edge 138 forms the second stop surface 84.

In one preferred form, the distance between the outer and inner peripheral surfaces 124 and 126, i.e. the thickness of the spacer 100 generally corresponds to the thickness of the stop sleeve 80, i.e. the distance between an outer and an inner peripheral surface 142 and 144 of the stop sleeve 80. The spacer 100 cooperates with the stop sleeve 80 such that the inner peripheral surfaces 126 and 144 of the spacer 100 and the stop sleeve 88, respectively, provide a substantially uniform surface and the spacer 100 enhances the structural integrity of the cover 88 and the assembled stop attachment 10.

A ring 146 is formed on the lower end 134 of the stop sleeve 80, and the ring 146 provides an annular, generally upwardly facing surface 148 and an annular, generally downwardly facing surface 150. The annular downwardly facing surface 150 of the ring 94 forms the lower end 134 of the stop sleeve 80. An aperture 151 is formed through the ring 146 intersecting the upwardly and downwardly facing surfaces 148 and 150.

The cover 88 and the stop sleeve 80 are each sized such that, when the cover 88 is connected to the stop sleeve 80 via the fastener 86, the lower side 98 of the attaching plate 94 is spaced a distance 153 from the upwardlly facing surface 148 of the ring 146 and the distance 153 is sized such that the stop attachment 10 is insertable in the operating position with the attaching plate 94 disposed generally above the bushing 56 and the ring 146 is disposed generally below the bushing 60. It should be noted that the aperture 116 is positioned in the cover 88, and the apertures 160 and 162 are positioned in the stop sleeve 80 to fix the distance 153 between the attaching plate 94 and the ring 146. The aperture 116 can be elongated extending between the upper and the lower ends 90 and 92 of the cover 88 and, in this form, the stop sleeve 80 is adjustably movable in a direction generally toward the upper end 90 of the cover 80 to adjustingly decrease the distance 153 or in a direction generally toward the lower end 92 of the cover 88 to adjustingly increase the distance 153, thereby providing a stop attachment 10 having an adjustable distance 153 to accommodate hinge assemblies of different lengths, the fastener 86 being utilized to secure the cover 88 to the stop sleeve 80.

A recess 152 is formed in the first edge 136 and is disposed generally between the upper and the lower ends 132 and 134 of the stop sleeve 80, the recess 152 being sized to clearingly accommodate a portion of one of the bushings on the hinge assembly 12 in an operating position of the stop attachment 10 and extending a distance arcuately into the stop sleeve 80 in a direction generally from the first edge 136 toward the second edge 138. A first recess 154 is formed in the second edge 138, and a portion of the first recess 154 intersects the upper end 132 of the stop sleeve 80, the recess 154 extending a distance in a direction generally from the upper end 132 toward the lower end 134. A second recess 156 is formed in the second edge 138, and the second recess 156 extends a distance in a direction generally from the lower end 134 toward the upper end 132 of the stop sleeve 80, the upwardly facing surface 148 of the ring 146 intersecting the second recess 156. The recesses 154 and 156 each extend a distance arcuately into the stop sleeve 80 in a direction generally from the second edge 138 toward the first edge 136 which is substantially equal to the arcuate distance the recess 152 extends into the first edge 136. Each of the recesses 154 and 156 are sized to clearingly accommodate a portion of one of the bushings on the hinge assembly 12 in an operating position of the stop attachment 10.

A pair of threaded apertures 160 and 162 are formed through the stop sleeve 80, and each aperture 160 and 162 extends radially through the stop sleeve 80 intersecting the inner and outer peripheral surfaces 144 and 142, respectively. The apertures 160 and 162 are each spaced a distance from the lower end 134 of the stop sleeve 80, and the apertures 160 and 162 are spaced arcuately or circumferentially about the stop sleeve 80 for selectively securing the stop sleeve 80 to the housing assembly 74 in different, predetermined positions for reasons and in a manner to be described in greater detail below.

In the assembled position of the stop attachment 10 with the cover 88 secured to the stop sleeve 80 via the fastener 86, the stop attachment 10 is connected to the hinge assembly 12 by first removing the pintle 42 and positioning the stop attachment 10 near the connecting portions of the first and the second hinge leaves 14 and 28 provided via the bushings 52, 54, 56, 58 and 60, the inner peripheral surfaces 126 and 144 of the spacer 100 and the stop sleeve 80, respectively, being positioned generally adjacent portions of the outer peripheral surfaces of the bushings 52, 54, 56, 58 and 60. The lower side 98 of the attaching plate 94 is disposed above the bushing 56 and the aperture 130 through the attaching plate 94 is generally aligned with the opening 62 in the bushing 56 or, more particularly, with the aligned openings through the bushings 52, 54, 56, 58 and 60. The upwardly facing surface 148 of the ring 146 is disposed below the bushing 60 with the aperture 151 generally aligned with the openings in the bushings 52, 54, 56, 58 and 60. The pintle 42 is inserted through the aperture 151 in the ring 146 and through the aligned openings in the bushings 52, 54, 56, 58 and 60, to a position wherein the surface 50 of the head 48 engages the upper side 96 of the attaching plate 94 and a portion of the pintle 42 near the end 46 is disposed through the aperture 151 in the ring 146. In the form of the invention shown in FIGS. 1 through 8, the cap 72 is secured to the bushing 60 and the cap 72 is disposed in the aperture 151 through the ring 146. In the operating position of the stop attachment 10 connected to the hinge assembly 12 in a manner just described, the engagement between the pintle 42 and the attaching plate 94, and the engagement between the cap 72 and the ring 146 cooperate to secure the stop attachment 10 to the hinge assembly 12 while allowing the stop attachment 10 to rotate generally about the pivot axis 64.

In an assembled position of the stop attachment 10, a portion of the outer peripheral surface 142 of the stop sleeve 80 is positioned generally adjacent a portion of the inner peripheral surface 114 of the cover 88, and the upper end 132 of the stop sleeve 80 is positioned near the lower end 104 of the spacer 100, the lower end 134 of the stop sleeve 80 being positioned near the lower end 92 of the cover 88. The stop sleeve 80 is movably positionable with respect to the housing assembly 74 and, more particularly, the stop sleeve 80 is movable in a first direction 164 and in a generally opposite second direction 166 with respect to the cover 88 for selectively positioning the first and the second stop surfaces 82 and 84 of the stop sleeve 80 in different, predetermined positions with respect to the disposition of the first and the second stop surfaces 76 and 78 of the housing assembly 74.

Referring more particularly to the embodiment of the invention shown in FIGS. 1 through 8, the stop sleeve 80 is movably positionable with respect to the housing assembly 74 in two predetermined positions, i.e. the stop sleeve 80 is movable to a first position (shown in FIG. 7) wherein the aperture 162 in the stop sleeve 80 is aligned with the aperture 116 in the cover 88 and, in this first position, the fastener 86 is threadedly disposed through the aligned apertures 162 and 116, thereby securedly connecting the stop sleeve 80 to the cover 88. Also, the stop sleeve 80 is movable to a second position (shown in FIG. 8) wherein the aperture 160 in the stop sleeve 80 is aligned with the aperture 116 in the cover 88 and, in this second position, the fastener 86 is threadedly disposed through the aligned apertures 160 and 116 securedly connecting the stop sleeve 80 to the cover 88.

In the first position, the stop sleeve 80 is connected to the cover 88 and positioned such that the first stop surface 82 of the stop sleeve 80 is disposed in a generally coplanar disposition with respect to the first stop surface 76 of the cover 88 and the second stop surface 84 of the stop sleeve 80 is disposed in a generally coplanar disposition with respect to the second stop surface 78 of the cover 88, the first stop surfaces 76 and 82 being disposed to contactingly engage the second face 26 of the first hinge leaf 14 and the second stop surfaces 78 and 84 being disposed to contactingly engage the second face 40 of the second hinge leaf 28. In the first position of the stop sleeve 80 and the cover 88, the first stop surfaces 76 and 82 of the cover 88 and the stop sleeve 80, respectively, are each disposed an angular or arcuate distance from the second stop surfaces 78 and 94 of the cover 88 and the stop sleeve 80, respectively, and the angular distances 110 and 140 are sized that the first stop surfaces 76 and 82 each engage the second face 26 of the first hinge leaf 14 and the second stop surfaces 78 and 84 engage the second face 40 of the second hinge leaf 28 limiting the anuglar movement of the first and the second hinge leaves 14 and 28 to a predetermined angular distance 180, the angular distance 180 being approximately equal to one hundred thirty five degrees (135°) in the one embodiment of the invention as shown more clearly in FIG. 7.

If it is desired to selectively change the limit of the angular movement of the first and the second hinge leaves 14 and 28, the fastener 86 is removed from the aligned apertures 116 and 162, and the stop sleeve 80 is moved relative to the cover 88 to the second position wherein the aperture 116 in the cover 88 is aligned with the aperture 160 and, in this second position (shown in FIG. 8), the fastener 86 is threadedly disposed through the aligned apertures 116 and 160 thereby securedly connecting the stop sleeve 80 to the cover 88. In the second position of the stop sleeve 80 and the cover 88, the first stop surface 82 of the stop sleeve 80 is recessed an arcuate distance from the first stop surface 76 of the cover 88, the first stop surface 76 of the cover 88 being positioned to engage the second face 26 of the first hinge leaf 14, and the second stop surface 84 of the stop sleeve 80 is extended an arcuate distance beyond the second stop surface 78 of the cover 88, the second stop surface 84 of the stop sleeve 80 being positioned to engage the second face 40 of the second hinge leaf 28. Thus, in the second position, the stop sleeve 80 is connected to the cover 88 such that the first stop surface 76 of the cover 88 engages the first hinge leaf 14 and the second stop surface 84 of the stop sleeve 80 engages the second hinge leaf 28 limiting the movement of the first and the second hinge leaves 14 and 28 to a predetermined angular distance 172 which is substantially equal to ninety degrees (90°) in the opening direction 66. In view of the foregoing detailed description, it will be apparent to those skilled in the art that the additional apertures, similar to the apertures 160 and 162 could be provided in the stop sleeve 80 for alignment with the aperture 116 in the cover 88 so the stop surfaces 76, 78, 82 and 84 could be selectively positioned to engage and limit the anuglar movement of the first and the second hinge leaves 14 and 28 to various predetermined angular distances other than the two angular distances 172 and 180 described above with respect to the stop sleeve 80 and the cover 88.

In a typical installation, the hinge assembly 12 is connected to a first member (partially and diagrammatically shown in FIGS. 7 and 8 and designated therein via the general reference numeral 188) and a second member (partially and diagrammatically shown in FIGS. 7 and 8 and designated therein via the general reference numeral 190), and the hinge assembly 12 functions to provide a hinge connection between the first and the second members 188 and 190 such that the second member 190 is movable with respect to the first member 188 about the pivot axis 64 in the opening and the closing directions 66 and 68. Hinge assemblies and the utilization of hinge assemblies to provide a connection between two members are well-known in the art, the stop attachment of the present invention being particularly constructed such that the stop attachment 10 is removably connectable to existing hinge assembly installations (such as the hinge assembly 12, for example) for limiting the angular movement of the hinge assembly 12 in the opening directions 66 thereby limiting the angular movement of the second member 190 with respect to the first member 188 in the opening directions.

In one particular typical installation, the first member 188, more particularly, is a stationary member (the first member 188 being sometimes referred to herein as the "stationary member 188"), the second member 190, more particularly, is a movable member (the second member 190 being sometimes referred to herein as the "movable member 190"), and the hinge assembly 12 provides the hinge connection between the stationary member 188 and the movable member 190 such that the movable member 190 is movable with respect to the stationary member 188 in the opening and the closing directions 66 and 68 about the pivot axis 64. The stationary member 188 can be a portion of a supporting structure forming a door opening and the movable member 190 can be a door, the hinge assembly 12 providing the connection between the supporting structure and the door and the stop attachment 10 of the present invention being removably connectable to the hinge assembly 12 for limiting the angular movement of the door relative to the supporting structure in the opening directions 66. Thus, the stop attachment 10 of the present invention can be quickly and conveniently connected to existing hinge assembly installations for the purpose of limiting the angular movement of doors, thereby replacing unsightly, inconvenient and, in many instances, unusable door stops of the type permanently secured to the floor near the door or to a nearby portion of the wall structure (not shown), while still providing the desired protection of nearby structures by preventing the angular movement of the door to exceed a predetermined angular distance, and thus substantially reducing the possibility of the door being moved against such nearby structures.

EMBODIMENT OF FIGS. 9, 10 AND 11

Figure 9:
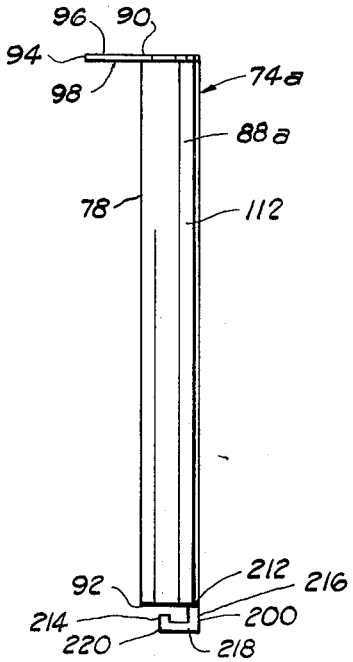
FIG. 9 is a side elevational view of a modified housing assembly.
Figure 11:
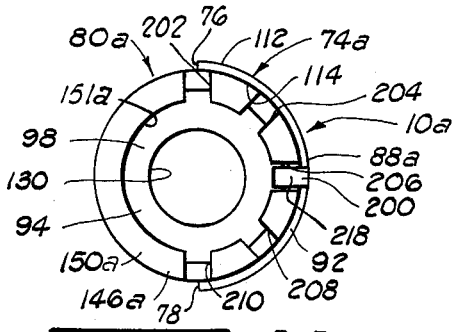
FIG. 11 is a partial lower end elevational view of the modified housing assembly of FIG. 9 and the stop sleeve of FIG. 10 in an assembled position removably connected to the hinge assembly.

A modified housing assembly 74*a* is shown in FIGS. 9 and 11, and the housing assembly 74*a* is constructed exactly like the housing assembly 74 described in detail before, except an extension flange 200 is connected to the lower end 92 of the cover 88*a* for removably connecting the housing assembly 74*a* to a modified stop sleeve 80*a*. The stop sleeve 80*a* is constructed exactly like the stop sleeve 80 described in detail before, except a plurality of circumferentially spaced location recesses 202, 204, 206, 208 and 210 are formed in the downwardly facing surface 150*a* of the ring 146*a*. Each of the location recesses 202, 204, 206, 208 and 210 also extends into the inner peripheral surface formed in the ring 146*a* via the aperture 151*a* for accommodating a portion of the extension flange 200 in an assembled position of the housing assembly 74*a* and the stop sleeve 80*a*. Thus, each of the location recesses 202, 204, 206, 208 and 210 is shaped to receive a portion of the extension flange 200 on the cover 88*a* for selectively and adjustingly positioning the stop sleeve 80*a* with respect to the housing assembly 74 *a* in a manner and for reasons similar to those described before with respect to the aperture 116 in the cover 88 and the apertures 160 and 162 in the stop sleeve 80.

The extension flange 200 on the cover 88*a* is generally U-shaped having a first end 212 and a second end 214. The first end 212 is connected to the lower end 92 of the cover 88*a* and a first leg portion 216 of the extension flange 200 extends a distance downwardly therefrom to a connecting portion 218. The connecting portion 218 extends a distance angularly from the first leg portion 216 radially inwardly to a second leg portion 220. The second leg portion 220 extends angularly upward from the connecting portion 218 terminating with the second end 214, the second end 214 being disposed in a plane generally near the planar disposition of the lower end 92, as shown more clearly in FIG. 9.

Figure 10:
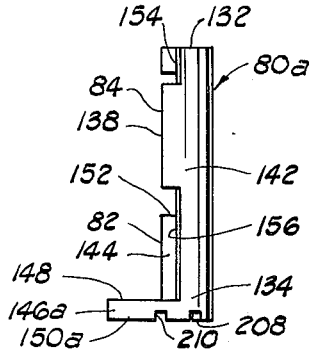
FIG. 10 is a side elevational view of a modified stop sleeve for use in connection with the housing assembly of FIG. 9.

The connecting portion 218 of the extension flange 200 is selectively insertable in the location recesses 202, 204, 206, 208 and 210 of the stop sleeve 80*a* for adjustingly and removably connecting the stop sleeve 80*a* to the housing assembly 74*a*. In the assembled position with the extension flange 200 selectively disposed in one of the location recesses 202, 204, 206, 208 and 210, the second leg portion 220 of the extension flange 200 is selectively disposed in the portion of one of the location recesses 202, 204, 206, 208 and 210 formed in the inner peripheral surface of the ring 146*a* via the aperture 151*a*, thereby providing sufficient clearance so the cap 72 (not shown in FIGS. 9, 10 and 11) can be disposed within the aperture 151*a* in the ring 146*a* in an operating position with the stop attachment 10*a* connected to a hinge assembly such as the hinge assembly 12 described in detail before. More particularly, the selective dispositioning of the extension flange 200 within one of the location recesses 202, 204, 206, 208 and 210 adjustingly positions the first stop surface 82 of the stop sleeve 80*a* with respect to the first stop surface 76 of the housing assembly 74*a* and the second stop surface 84 of the stop sleeve 80*a* with respect to the second stop surface 78 of the housing assembly 74*a* for adjustingly limiting the degree of angular movement of the first hinge leaf 14 and the second hinge leaf 28 in the opening directions 66.

When the extension flange 200 is located in one of the location recesses 202, 204, 206, 208 and 210 (the extension flange 200 being shown positioned in the location recess 206 in FIG. 11, for example), the stop sleeve 80*a* is secured in one position with respect to the cover 88*a* via the engagement between the connecting portion 218 and the second leg portion 220 of the extension flange 200 and the surfaces formed in the stop sleeve 80*a* via the location recesses 202, 204, 206, 208 and 210. The positioning of the extension flange 200 in one of the location recesses 202, 204, 206, 208 and 210 limits the degree of angular movement of the first and the second hinge leaves 14 and 28 to one predetermined angular distance, and the re-positioning of the extension flange 200 into one of the other location recesses 202, 204, 206, 208 and 210 selectively changes the degree of angular movement of the first and the second hinge leaves 14 and 28 to one other predetermined angular distance. The stop attachment 10*a* is secured to the hinge assembly 12 in the operating position in a manner like that described before with respect to the stop attachment 10 and the hinge assembly 12, i.e. the pintle 42 is removed from the hinge assembly 12 and the stop attachment 10*a* is positioned generally adjacent the connecting portions of the first and the second hinge leaves 14 and 28 (the bushings 52, 54, 56, 58 and 60) with the attaching plate 94 disposed above the bushing 56 and the ring 146*a* disposed below the bushing 60. The pintle 42 is disposed through the aperture 130 in the attaching plate 94 for connecting the housing assembly 74*a* to the hinge assembly 12 and the cap 72 is disposed in the aperture 151*a* in the ring 146*a* for connecting the stop sleeve 80*a* the hinge assembly 12. The engagement between the connecting portion 218 and the second leg portion 220 and the portions of the ring 146*a* formed via one of the location recesses 202, 204, 206, 208 and 210 secures the housing assembly 74*a* to the stop sleeve 80*a* in a manner fixing the rotational position of the stop sleeve 80*a* relative to the housing assembly 74*a* thereby fixing the disposition of the first stop surfaces 76 and 82 and the second stop surfaces 78 and 84 for limiting the angular movement of the first and the second hinge leaves 14 and 28 to a predetermined angular distance determined via the particular location recess 202, 204, 206, 208 and 210 accommodating the connecting portion 218 and the second leg portion 220 of the extension flange 200. The second leg 220 of the extension flange 200 engages the ring 146*a* preventing the stop sleeve 80*a* from being forced away from the cover 88*a* disconnecting the stop sleeve 80*a* from the cover 88*a* after the stop attachment 10*a* has been connected to the hinge assembly 12 in the operating position, thereby maintaining the stop sleeve 80*a* and the cover 88*a* in the assembled position, the hinge assembly 12 preventing the movement of the cover 88*a* and the stop sleeve 80*a* toward the hinge assembly 12 and cooperating to maintain the stop attachment 10*a* in the assembled position. The extension flange 200 cooperates with the location recesses 202, 204, 206, 208 and 210 to removably connect the stop sleeve 80*a* *a*and the cover 88*a* in a manner such that the stop sleeve 80*a* can be disconnected from the cover 88*a* quickly and easily after the stop attachment 10*a* has been removed from the hinge assembly 12 without requiring the removal of a fastener, such as the fastener 86, for example, and the stop sleeve 80*a* can be re-located or re-positioned to another location recess 202, 204, 206, 208 and 210 and subsequently connected to the cover 88*a* via the extension flange 200 connection in a relatively quick and efficient manner without the necessity of a fastener connection, such as the fastener 86, for example, the housing assembly 74*a* then being connected to the hinge assembly 12 in the manner described before.

Thus, the modified stop attachment 10*a* formed by the cover 88*a* and the stop sleeve 80*a* will operate in a manner and for reasons exactly like that described before with respect to the stop attachment 10 except the extension flange 200 cooperates with the location recesses 202, 204, 206, 208 and 210 to provide an alternate manner for selectively and adjustingly varying the positions of the first stop surfaces 76 and 82 and the positions of the second stop surfaces 78 and 84 for adjustingly limiting the degree of angular movement of the first and the second hinge leaves 14 and 28.

EMBODIMENT OF FIG. 12

Figure 12:
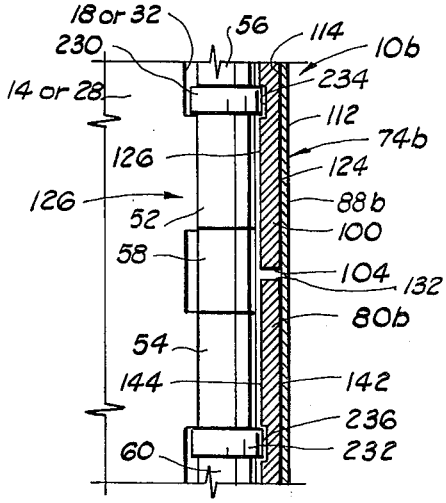
FIG. 12 is a fragmental, partial sectional, partial elevational view of another modified housing assembly and another modified stop sleeve in an assembled position removably connected to a hinge assembly of the type having bearings disposed between the bushings of the first and second hinge leaves of the hinge assembly.

Shown in FIG. 12 is another modified stop attachment 10*b* which is constructed exactly like the stop attachment 10, except the stop attachment 10*a* includes a modified housing assembly 74*b* and a modified stop sleeve 80*b*. The housing assembly 74*b* and the stop sleeve 80*b* are constructed to be utilized with a hinge assembly 12*b* having a plurality of bearings disposed between the bushings 56 and 60 (two bearings 230 and 232 being shown in FIG. 12, for example). The bearings 230 and 232 each extend radially a distance beyond the aligned bushings 52, 54, 58 and 60 in an assembled position of the hinge assembly 12*b*. The spacer 100*b* of the housing assembly 74*b* has a recess 234 formed in the inner peripheral surface 126*b* and the recess 234 is positioned and sized to clearingly accommodate one of the bearings 230 in an operating position of the stop attachment 10*b* connected to the hinge assembly 12*b*. The stop sleeve 80*b* has a recess 236 formed in the inner peripheral surface 144*b* and the recess 236 is positioned and sized such that, in the operating position with the stop attachment 10*b* connected to the hinge assembly 12*b*, the recess 236 clearingly accommodates the bearing 232.

The stop attachment 10*b* will operate to selectively limit the degree of angular movement of the hinge assembly 12*a* in a manner and for reasons exactly like that described before with respect to the stop attachment 10 and the hinge assembly 12.

Changes may be made in the construction and the arrangement of the various parts, elements and assemblies described herein without departing from the spirit and the scope of the invention as defined in the following claims.

What is claimed is:

1. A stop attachment removably connectable to a hinge assembly having a first hinge leaf, a second hinge leaf and a pintle hingedly connecting the first hinge leaf and the second hinge leaf for pivotal movement of the first and the second hinge leaves about the pintle connection therebetween, comprising:

a housing assembly having a first stop surface and a second stop surface formed on portions thereof, and a portion removably connectable to the hinge assembly;

a stop sleeve having a first stop surface and a second stop surface formed on portions thereof, and a portion removably connectable to the hinge assembly; and means connecting the housing assembly to the stop sleeve for positioning at least one of the first stop surfaces of the housing assembly and the stop sleeve to engage the first hinge leaf and for positioning at least one of the second stop surfaces of the housing assembly and the stop sleeve to engage the second hinge leaf in an operating position of the stop attachment, the housing assembly and the stop sleeve being connected to the hinge assembly in the operating position of the stop attachment.

2. The stop attachment of claim 1 wherein the first and the second hinge leaves each include at least one bushing and wherein the pintle extends through each of the bushings for hingedly connecting the first and the second hinge leaves, and wherein the housing assembly is defined further as covering a portion of the bushings of the first and the second hinge leaves in the operating position of the stop attachment.

3. The stop attachment of claim 2 wherein the stop sleeve is defined further as covering a portion of the bushings of the first and the second hinge leaves in an operating position of the stop attachment.

4. The stop attachment of claim 1 wherein the hinge assembly includes a cap connected to one of the bushings and wherein the stop sleeve is defined further to include:

a ring, having an aperture formed through a portion thereof, connected to the stop sleeve and extending a distance from the inner peripheral surface of the stop sleeve, the ring being movably connected to the hinge assembly in the operating position and the cap being retainingly disposed within the aperture in the ring in the operating position of the stop attachment.

5. The stop attachment of claim 1 wherein the stop sleeve is defined further as being movably positionable with respect to the housing assembly for selectively and adjustingly positioning the first stop surface of the stop sleeve with respect to the first stop surface of the housing assembly and for selectively and adjustingly positioning the second stop surface of the stop sleeve with respect to the second stop surface of the housing assembly, at least one of the first stop surfaces of the housing assembly and the sleeve being engageable with the first hinge leaf and at least one of the second stop surfaces of the housing assembly and the stop sleeve being engageable with the second hinge leaf at each position of the stop sleeve and the housing assembly for selectively limiting the degree of angular movement of the first and the second hinge leaves in one direction.

6. The stop attachment of claim 4 wherein the housing assembly is defined further as being movably connectable to the hinge assembly in the operating position of the stop attachment; and wherein the stop sleeve is defined further as being movably connectable to the hinge assembly in the operating position of the stop attachment.

7. The stop attachment of claim 1 wherein the first hinge leaf includes a first and a second face and the second hinge leaf includes a first and a second face; and wherein the means connecting the housing assembly to the stop sleeve is defined further as positioning at least one of the first stop surfaces of the housing assembly and the stop sleeve to engage the second face of the first hinge leaf and positioning at least one of the second stop surfaces of the housing assembly and the stop sleeve to engage the second face of the second hinge leaf to limit the degree of angular movement of the first and the second hinge leaves in an opening direction, the first face of the first hinge leaf being moved in a direction generally away from the first face of the second hinge leaf during the movement of the first and the second hinge leaves in the opening direction.

8. The stop attachment of claim 7 wherein the housing assembly includes an aperture formed through a portion thereof, and wherein the stop sleeve includes two apertures formed through a portion thereof; and wherein the means connecting the housing assembly to the stop sleeve is defined further to include: a fastener, the fastener extending through the aperture in the housing assembly and through one of the apertures in the stop sleeve thereby connecting the housing assembly to the stop sleeve in a first position and positioning at least one of the first stop surfaces of the housing assembly and the stop sleeve to engage the first hinge leaf and for positioning at least one of the second stop surfaces of the housing assembly and the stop sleeve to engage the second hinge leaf limiting the degree of angular movement of the first and the second hinge leaves to one predetermined angular distance in the opening direction, and the fastener extending through the aperture in the housing assembly and the other aperture in the stop sleeve thereby connecting the housing assembly to the stop sleeve in a second position and positioning at least one of the first stop surfaces of the housing assembly and the stop sleeve to engage the first hinge leaf and for positioning at least one of the second stop surfaces of the housing assembly and the stop sleeve to engage the second hinge leaf limiting the degree of angular movement of the first and the second hinge leaves to one other predetermined angular distance in the opening direction.

9. The stop attachment of claim 1 wherein the housing assembly is defined further to include:

a cover having a first and a second edge, an inner peripheral surface, an outer peripheral surface, an upper end and a lower end, the first stop surface of the housing assembly being formed on the first edge of the cover and the second stop surface of the housing assembly being formed on the second edge of the cover; and an attaching plate connected to the cover and extending a distance therefrom, the attaching plate being connectable to the hinge assembly for connecting the housing assembly to the hinge assembly in the operating position of the stop attachment.

10. The stop attachment of claim 9 wherein the stop sleeve is defined further as having a first and a second edge, an inner peripheral surface, an outer peripheral surface, an upper end and a lower end, the first stop surface of the stop sleeve being formed on the first edge of the stop sleeve and the second stop surface of the stop sleeve being formed on the second edge of the stop sleeve, a portion of the outer peripheral surface of the stop sleeve near the upper end thereof being disposed generally adjacent the inner peripheral surface of the cover near the lower end thereof in the assembled position of the stop attachment with the cover connected to the stop sleeve.

11. The stop attachment of claim 10 wherein the housing assembly is defined further to include:

a spacer connected to the cover, having a first and a second edge, an inner peripheral surface and an outer peripheral surface, an upper end and a lower end, the outer peripheral surface of the spacer being disposed adjacent the inner peripheral surface of the cover and the lower end of the spacer being spaced a distance from the lower end of the cover, the inner peripheral surface of the spacer disposed near a portion of the hinge assembly in the operating position of the stop attachment and the portion of the stop sleeve disposed adjacent the inner peripheral surface of the cover being positioned generally between the lower end of the spacer and the lower end of the cover.

12. The stop attachment of claim 11 wherein the inner peripheral surface of the spacer is defined further as being disposed in a generally coplanar disposition with respect to the inner peripheral surface of the stop sleeve in the operating position of the stop attachment, the inner peripheral surfaces of the cover and the stop sleeve being disposed near and hingedly connected to portions of the hinge assembly in the operating position of the stop attachment.

13. The stop attachment of claim 10 wherein the stop sleeve is defined further to include:

means connected to the stop sleeve having a portion extending a distance therefrom for connecting the stop sleeve to the hinge assembly in the operating position of the stop attachment.

14. The stop attachment of claim 13 wherein the means for connecting the stop sleeve to the hinge assembly is defined further as movably connecting the stop sleeve to the hinge assembly.

15. The stop attachment of claim 13 wherein the means for connecting the stop sleeve to the housing assembly is defined further to include:

an extension flange having a first end and a second end, the first end of the extension flange being connected to the cover and the extension flange being removably connectable to the stop sleeve.

16. The stop attachment of claim 15 wherein the means for connecting the stop sleeve to the housing assembly is defined further to include:

a ring, having an upwardly facing surface and a downwardly facing surface, connected to the stop sleeve and extending a distance from the stop sleeve, more than one recess, each recess being formed in a portion of the ring and the recesses spaced at predetermined positions on the ring and each recess being shaped to receive a portion of the extension flange, the extension flange being selectively and removably disposable in the recesses formed in the ring, the disposition of the extension flange in each of the recesses connecting the cover to the stop sleeve and positioning the first and the second stop surfaces of the cover and the stop sleeve for engaging the first and the second hinge leaves and limiting the angular movement of the first and the second hinge leaves to a predetermined angular movement.

17. The stop attachment of claim 10 wherein the hinge assembly includes at least one bearing extending a distance from the connecting portions of the first and the second hinge leaves; and wherein the cover is defined further to include a recess formed in a portion of the inner peripheral surface thereof for clearingly accommodating a portion of one of the bearings of the hinge assembly in the operating position of the stop attachment; and wherein the stop sleeve is defined further to include a recess formed in a portion of the inner peripheral surface of the stop sleeve for clearingly accommodating a portion of one of the bearings of the hinge assembly in the operating position of the stop attachment.

* * * * *